US008906323B2

(12) United States Patent
Momose

(10) Patent No.: US 8,906,323 B2
(45) Date of Patent: Dec. 9, 2014

(54) MICROCHIP

(75) Inventor: Shun Momose, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 720 days.

(21) Appl. No.: 12/253,369

(22) Filed: Oct. 17, 2008

(65) Prior Publication Data

US 2009/0104077 A1 Apr. 23, 2009

(30) Foreign Application Priority Data

Oct. 18, 2007 (JP) ..... 2007-271225

(51) Int. Cl.
*B01L 3/00* (2006.01)

(52) U.S. Cl.
CPC ..... *B01L 3/50273* (2013.01); *B01L 2400/0409* (2013.01); *B01L 2400/0412* (2013.01); *B01L 2200/10* (2013.01); *B01L 2300/088* (2013.01); *B01L 2300/0806* (2013.01); *B01L 2200/0647* (2013.01); *B01L 2300/0627* (2013.01)
USPC ..... 422/506; 422/502; 422/503; 422/504

(58) Field of Classification Search
USPC ..... 422/100, 500–504, 506, 507; 436/512, 436/517, 518, 532–535
See application file for complete search history.

(56) References Cited

U.S. PATENT DOCUMENTS

2002/0027133 A1* 3/2002 Kellogg et al. ..... 219/543
2004/0209354 A1* 10/2004 Mathies et al. ..... 435/287.2
2008/0156079 A1 7/2008 Momose et al.
2008/0296734 A1 12/2008 Momose
2009/0084738 A1 4/2009 Momose
2009/0098658 A1 4/2009 Momose et al.
2009/0111675 A1 4/2009 Yokogawa et al.
2009/0135407 A1 5/2009 Kageyama et al.
2009/0142232 A1 6/2009 Okada et al.
2009/0155125 A1 6/2009 Michiue et al.
2009/0232708 A1 9/2009 Yokogawa et al.
2009/0269854 A1 10/2009 Kageyama

FOREIGN PATENT DOCUMENTS

JP 2002-538480 11/2002
JP 2005-134349 5/2005
JP 2006-349347 12/2006
JP 2007-155484 6/2007
JP 2007-285854 11/2007
JP 2008-164360 * 7/2008 ..... G01N 35/00

OTHER PUBLICATIONS

Grover, W.H.; Mathies, R.A. "An integrated microfluidic processor for single nucleotide polymorphism-based DNA computing." Lab on a Chip, 2005, 5, pp. 1033-1040.*

(Continued)

*Primary Examiner* — Paul Hyun
*Assistant Examiner* — Robert Eom
(74) *Attorney, Agent, or Firm* — Fish & Richardson P.C.

(57) ABSTRACT

A microchip having a fluid circuit therein for passing a liquid is provided, wherein the fluid circuit has a first reservoir and a second reservoir for storing at least a part of the liquid, a first path connecting the first reservoir and the second reservoir, and a second path connecting the first reservoir and the second reservoir at a position different from the first path, and the first reservoir, the second reservoir, the first path, and the second path constitute a circular path capable of circulating the liquid.

6 Claims, 5 Drawing Sheets

(56) References Cited

OTHER PUBLICATIONS

Atencia et al., Steady flow generation in microcirculator systems, Lab Chip, 2006, 6, p. 567-674.*

U.S. Appl. No. 12/467,404, filed May 18, 2009.
U.S. Appl. No. 12/424,913, filed Apr. 16, 2009.
Japanese Office Action for JP Application No. 2007-271225 dated Feb. 21, 2012, with English translation.

* cited by examiner

FIG.3A
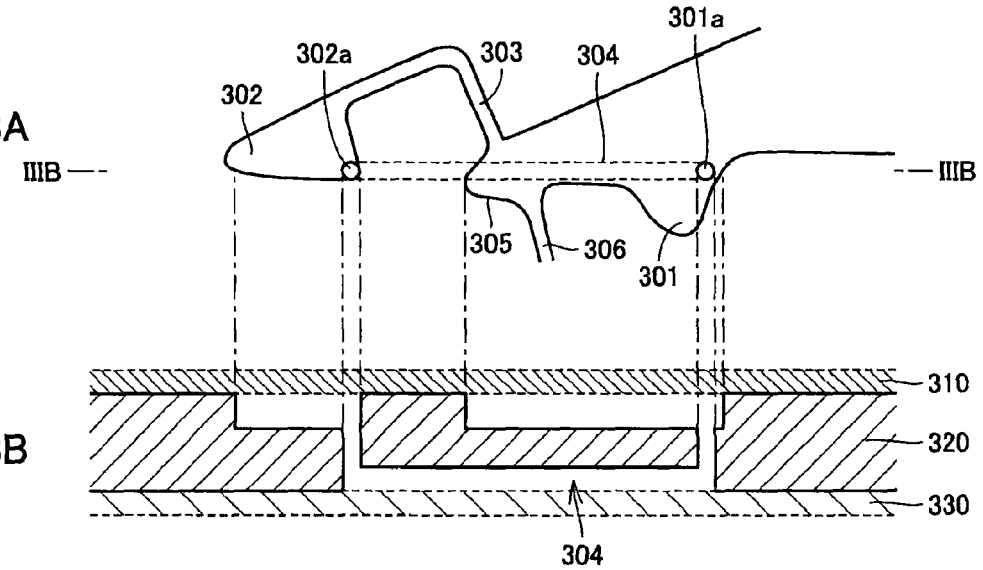
FIG.3B
FIG.4A
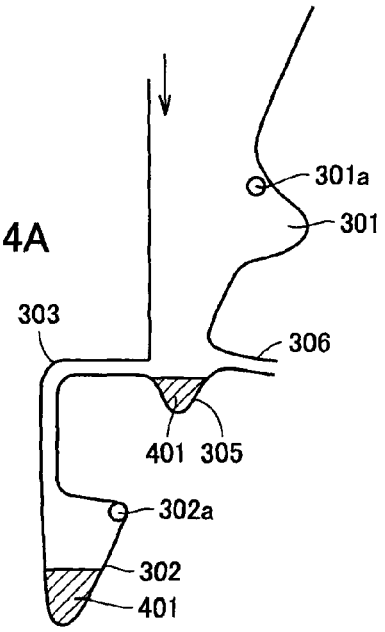
FIG.4B
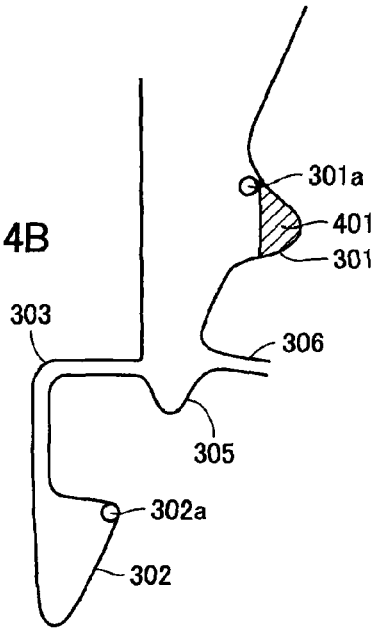

MICROCHIP

BACKGROUND OF THE INVENTION

1. Field of the Invention

The present invention relates to a microchip useful as a μ-TAS (Micro Total Analysis System) that is suitably used for biochemical testing of DNA, protein, cells, immunity, or blood, chemical synthesis, and environmental analysis, and more particularly to a microchip having a fluid circuit therein.

2. Description of the Related Art

In recent years, in the field of medicine, health, food, drug creation and so on, there is an increasing importance of sensing, detecting, or quantitating a biological substance such as DNA (Deoxyribo Nucleic Acid), an enzyme, an antigen, an antibody, protein, virus, or cells as well as a chemical substance. Therefore, various biochips and microchemical chips (hereafter, these are generally referred to as microchips) are proposed that can conveniently measure these.

Such a microchip can perform a series of experiments and analysis operations that are carried out in experiment laboratories within a chip of several cm square and having a thickness of several mm, thereby producing a lot of advantages such as reduction of the needed amount of the samples and reagents to be minute, reduction of the costs, increase in the reaction speed, enablement of testing with a high throughput, and enablement of obtaining a test result directly at the site of collecting the sample, so that the microchip is used suitably for biochemical testing, for example.

Among the microchips, a microchip having a fluid circuit in the inside thereof performs reaction, mixing, or detection of a specific component with use of the portions arranged at appropriate positions and minute paths (for example, having a width of several hundred μm) that connect these portions in an appropriate manner, constituting the fluid circuit. A series of operations within such a fluid circuit can be carried out by application of a centrifugal force to the microchip. As the aforesaid portions, a liquid reagent holding portion that holds liquid reagent to be subjected to reaction (or mixing) with a sample to be an object of testing, analysis, or the like, a measuring portion to measure the sample or the liquid reagent, a reaction (mixing) portion for subjecting the sample and the liquid reagent to reaction (or mixing), and a detecting portion for analyzing and/or testing the reaction liquid (or mixed liquid) can be mentioned.

In the meantime, as a method for quantitatively detecting a trace amount of an object substance contained in a sample by an antigen-antibody reaction, the ELISA (Enzyme-Linked Immunosorbent Assay, also referred to as the sandwich method) is a suitable method that is often used, and has advantageous features such as being capable of detecting the object substance with a high sensitivity and being excellent in the quantitativeness. The ELISA method is a method such that, after a bound body of an object substance and an enzyme-labeled antibody is bonded to an antibody immobilized to a solid phase such as beads, a color generating reaction is let to occur by adding a color-generating substrate, and quantification is performed by measuring the optical absorbance of the produced color-generating substance. Here, in the ELISA method, after a bound body made of the immobilized antibody, the object substance, and the enzyme-labeled antibody is formed, a step of cleaning the solid phase such as beads will be essential in order to remove the free enzyme-labeled antibody. Since the quantitated value will be largely affected when the free enzyme-labeled antibody is present, the cleaning must be carried out carefully and thoroughly.

In the case of quantitating the object substance by the ELISA method using a microchip having a fluid circuit therein, as a means for carefully and thoroughly cleaning the aforesaid beads, repetition of operations of introducing a cleaning liquid to the site (beads trap) loaded with the beads in the microchip, letting the cleaning liquid pass therethrough, and discharging the cleaning liquid can be mentioned as an example. However, by this method, the cleaning liquid is discarded each time the cleaning liquid is let to pass within the beads trap, whereby the measuring apparatus will have a very large scale such as necessitating a cleaning liquid supplying apparatus and an exhaust liquid collecting apparatus on the outside of the microchip, thereby degrading the inherent convenience that the microchip originally has.

Japanese Patent Laying-Open No. 2005-134349 discloses using a microchip having a liquid reservoir on one surface of a substrate, immobilizing an analysis object substance within the liquid reservoir, adding a bound body of a labeling substance and a partner capable of being specifically bound to the analysis object substance to perform a bonding reaction, and thereafter cleaning the liquid reservoir by removing the unreacted labeled partner. However, in this microchip, the site for performing the reaction and the site to be cleaned are formed on the outside surface of the microchip, so that the fluid circuit inside the microchip is not cleaned. Further, the microchip disclosed in the document also necessitates external apparatuses such as a cleaning liquid supplying apparatus and an exhaust liquid collecting apparatus.

As described above, no microchip is currently known having a structure in which a fluid circuit in the inside of the microchip or a part thereof can be efficiently cleaned without being accompanied by disassembly of the microchip.

SUMMARY OF THE INVENTION

In the case of performing the quantitating operation by the ELISA method with use of a microchip having a fluid circuit in the inside thereof, in order to enable efficient cleaning, it seems to be extremely important that the fluid circuit of the microchip has a structure of being capable of circulating a liquid within a certain portion of the fluid circuit. This is because, when the fluid circuit has such a structure, the cleaning liquid that has been once passed within the beads trap can be introduced into the beads strap again, so that the circulation can be repeated as many times as necessary.

Therefore, an object of the present invention is to provide a microchip having a fluid circuit structure being capable of circulating the liquid in the fluid circuit within a certain portion of the fluid circuit.

The present invention provides a microchip having a fluid circuit therein for passing a liquid, the fluid circuit having a first reservoir and a second reservoir for storing at least a part of the liquid, a first path connecting the first reservoir and the second reservoir, and a second path connecting the first reservoir and the second reservoir at a position different from the first path, wherein the first reservoir, the second reservoir, the first path, and the second path constitute a circular path capable of circulating the liquid.

In the microchip of the present invention, it is preferable that the liquid can be circulated only in one direction within the circular path. Also, the microchip of the present invention is preferably a microchip that passes the liquid within the fluid circuit by application of a centrifugal force. In this case, it is preferable that the liquid can be circulated within the circular path by application of centrifugal forces in two directions.

The microchip of the present invention may have a portion for being loaded with fillers at some position within the circular path. As the fillers, particles to which an antibody is immobilized can be mentioned as an example. By being provided with such fillers, the quantification of the object substance by the ELISA method can be carried out with use of the microchip of the present invention.

Also, the microchip of the present invention may have a measuring portion to measure the liquid at some position within the circular path.

The first path and the second path may be formed at an identical position or at different positions with respect to a thickness direction of the microchip. However, in the case of having a measuring portion to measure the liquid, they are preferably formed at different positions.

According to the microchip of the present invention, the liquid can be repeatedly circulated within the circular path formed by the first reservoir, the second reservoir, the first path, and the second path by application of a centrifugal force. The microchip of the present invention having such a structure can be suitably applied in the case in which the same liquid must be repeatedly circulated within a certain portion in the fluid circuit. As such a case, removal of the free enzyme-labeled antibody by cleaning in the ELISA method, measuring a liquid for plural times, and heterogeneous catalyst reaction within a microchip can be mentioned as examples.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 3A and 3B are schematic views illustrating one example of a principal portion of a fluid circuit with which the microchip of a second embodiment according to the present invention is provided.

FIGS. 4A and 4B are schematic flow charts illustrating one example of a method of measuring a liquid using the microchip of the second embodiment according to the present invention.

DESCRIPTION OF THE PREFERRED EMBODIMENTS

First Embodiment

Figure 1:
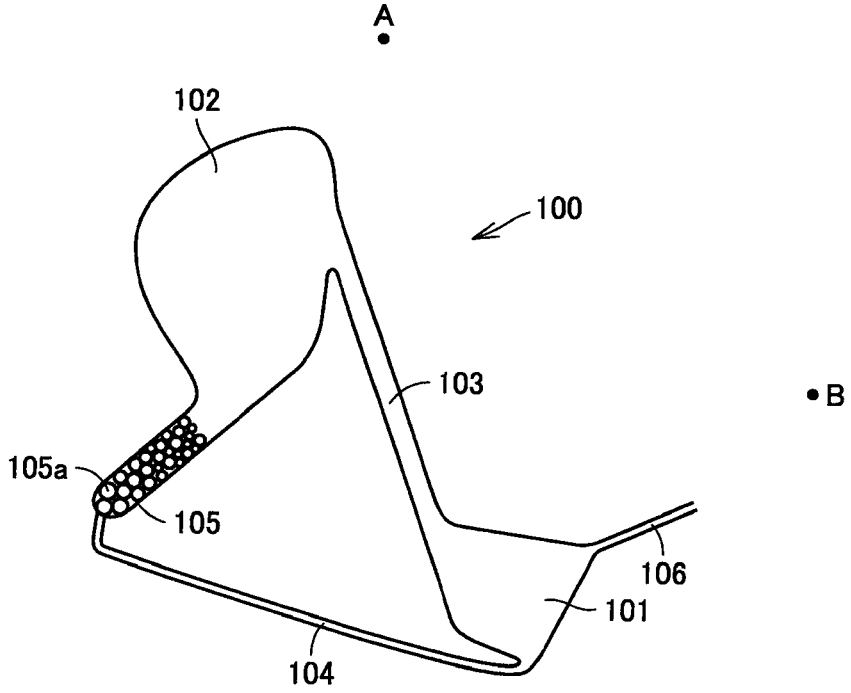
FIG. 1 is a schematic top view illustrating one example of a principal portion of a fluid circuit with which the microchip of a first embodiment according to the present invention is provided.

FIG. 1 is a schematic top view illustrating one example of a principal portion (circular path) of a fluid circuit with which the microchip of a first embodiment is provided. As described above, the microchip of the present invention may have a liquid reagent holding portion, a measuring portion, a reaction (mixing) portion, a detecting portion, and the like. However, for these portions, a conventionally known structure can be applied, so that the illustration thereof is not shown. Also, the principal portion (circular path) shown in FIG. 1 constitutes the fluid circuit of the microchip, and is formed in the inside of the microchip; however, in FIG. 1 (the same applies to the following FIGS. 2 to 6 as well), for providing a more definte description, the internal structure of the microchip is shown by being drawn out. The microchip of the present embodiment can be suitably used as a chip for quantitating an object substance by the ELISA method.

Here, a microchip having a fluid circuit therein such as in the present invention can be fabricated by a conventionally known method. Such a microchip can be composed, for example, of a first substrate and a second substrate laminated and stuck onto the first substrate. More specifically, the microchip can be fabricated by laminating the second substrate on the first substrate having a groove or grooves on a surface thereof so that the groove-forming-side surface of the first substrate may oppose the second substrate. By doing so, a fluid circuit consisting of the hollow portion constructed with the groove(s) provided on the first substrate surface and the surface of the second substrate opposing the first substrate. The shape and the pattern of the groove(s) formed on the first substrate surface are not particularly limited and they are determined so that the structure of the hollow portion constructed with the groove(s) and the second substrate surface will become an appropriate fluid circuit structure as desired.

Here, in fabricating the microchip, two or more substrates may be used. Also, the material of the substrates is not particularly limited, so that a plastic substrate, for example, can be used.

The size of the microchip is not particularly limited; however, it can be set to be about several cm in the longitudinal and lateral directions, and the thickness can be set to be about several mm to about 1 cm. Typically, the microchip is used by being mounted on an apparatus capable of applying a centrifugal force.

The microchip of the present embodiment has a circular path 100 shown in FIG. 1 as a part of the fluid circuit. Circular path 100 has a first reservoir 101 and a second reservoir 102 for storing at least a part of the liquid introduced into the fluid circuit of the microchip, and these are connected in the upper part thereof by a first path 103. Also, at the bottom of second reservoir 102, a column structure 105 for being loaded with fillers is provided. The bottom of column structure 105 and the bottom of first reservoir 101 are connected by a second path 104. That is, first reservoir 101, first path 103, second reservoir 102, and second path 104 constitute a circular path through which a liquid can be circulated. Regarding the thickness direction of the microchip, first path 103 and second path 104 are formed at an identical position, and therefore circular path 100 is parallel (or approximately parallel) to the microchip surface.

Further, at the end of the upper part of first reservoir 101 that is opposite to the side where first path 103 is connected, a third path 106 is formed for introducing a liquid into circular path 100 or discharging the liquid from circular path 100. Column structure 105 is loaded with beads 105*a* (for example, made of glass, Sepharose, or Chitopal) to which an antibody typically used in the ELISA method is immobilized.

In circular path 100 shown in FIG. 1, the liquid introduced into the inside thereof can be circulated only in one direction. The one direction means a direction of first reservoir 101→first path 103→second reservoir 102→second path 104→first reservoir 101. Specifically, a structure enabling circulation only in one direction such as this is realized by a structure such as the following. First, regarding the positional relationship between first reservoir 101 and second reservoir 102, first reservoir 101 is positioned on the side nearer to the centrifugal center (for example, point B in FIG. 1) that gives a centrifugal force in the leftward direction in FIG. 1 to circular path 100, as compared with second reservoir 102. Also, first reservoir 101 is positioned on the side farther to the centrifugal center (for example, point A in FIG. 1) that gives a centrifugal force in the downward direction in FIG. 1 to circular path 100, as compared with second reservoir 102.

The path diameter of second path 104 has a value sufficiently smaller than the diameter of the bottom of column structure 105 (for example, about 10 to 300 μm). By this structure, the flowing-out of the beads can be prevented.

Next, one example of a method of quantitating an object substance by the ELISA method using the microchip of the present embodiment having the above-described circular path 100 will be described with reference to FIGS. 2A to 2D. First, a liquid 201 containing a bound body of an antibody labeled with an enzyme and an object substance is introduced from third path 106, and is stored into first reservoir 101 (see FIG. 2A). Such introduction of liquid 201 into first reservoir 101 can be carried out by application of a centrifugal force in the downward direction in FIG. 2A relative to the microchip (which will be hereafter referred to as the downward direction, the same applying to other directions as well).

Figure 2A:
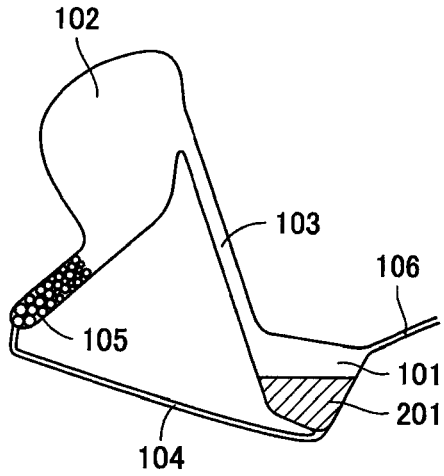
FIGS. 2A to 2D are schematic flow charts illustrating one example of a method of quantitating an object substance by the ELISA method using the microchip of the first embodiment having a circular path.
Figure 2C:
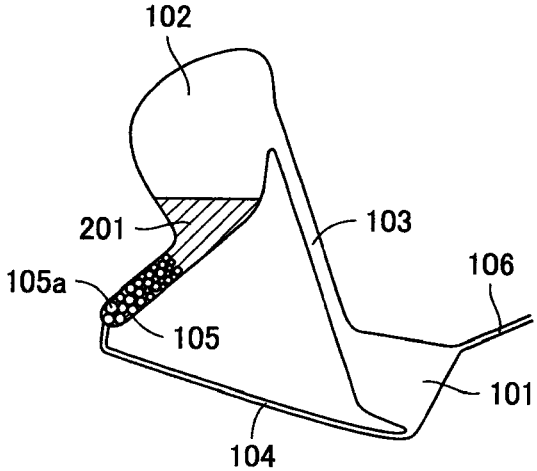
Figure 2B:
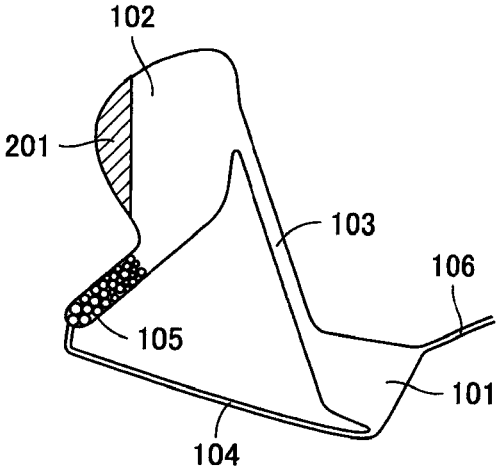
Figure 2D:
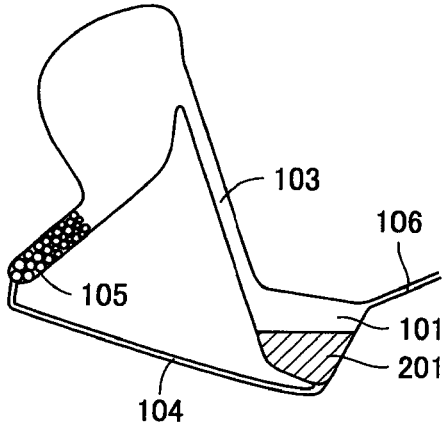

Next, by application of a centrifugal force in the leftward direction, liquid 201 is moved through first path 103 to second reservoir 102 to provide a state shown in FIG. 2B. Thereafter, by application of a centrifugal force in the downward direction, liquid 201 is moved to the lower part of second reservoir 102 as shown in FIG. 2C. By doing so, liquid 201 is brought into contact with beads 105*a* to which an antibody to the object substance is immobilized, in column structure 105, whereby an antigen-antibody reaction takes place to form a bound body of the immobilized antibody, the object substance, and the enzyme-labeled antibody. Subsequently, by further application of a centrifugal force in the downward direction, the whole amount of liquid 201 passes through column structure 105, whereby an antigen-antibody reaction is carried out, and liquid 201 passes through second path 104 to be stored into first reservoir 101 (see FIG. 2D). Liquid 201 stored in first reservoir 101 can be discharged from third path 106.

Next, in order to remove the free enzyme-labeled antibody adhering to beads 105*a* within column structure 105, column structure 105 is subjected to cleaning by a similar procedure. That is, after a cleaning liquid is introduced from third path 106, the cleaning liquid is moved to second reservoir 102 by application of a centrifugal force in the leftward direction, so as to provide a state similar to that of FIG. 2B. Here, as a cleaning liquid, for example, pure water or a buffer liquid such as a phosphate-buffered saline (PBS) or a Tris-buffered saline (TBS) can be used.

Next, by application of a centrifugal force in the downward direction, the cleaning liquid is moved to the bottom of second reservoir 102 and into column structure 105, and is passed through column structure 105. By doing so, the cleaning of the column structure of the first turn is carried out. The passed cleaning liquid passes through second path 104 to be stored into first reservoir 101, thereby providing a state similar to that of FIG. 2D. Next, in order to carry out cleaning the inside of column structure 105 with certainty, the cleaning liquid is circulated by a similar procedure. Such circulation cleaning is carried out for plural times in accordance with the needs.

After the cleaning is finished, a solution containing a color-generating substrate is passed within column 105 in the same manner as described above to let a color-generating reaction take place, and the optical absorbance of the produced color-generating substance is measured for quantification. The detection light for measurement of optical absorbance can be directly radiated to column structure 105, for example.

As shown above, by providing a circular path, the cleaning liquid can be repeatedly circulated within circular path 100, whereby the cleaning liquid can be efficiently used. This eliminates the need for a large-scale external apparatus such as a cleaning liquid supplying apparatus or an exhaust liquid collecting apparatus. Column structure 105 provided within circular path 100 is efficiently cleaned by the circulated cleaning liquid. Also, according to circular path 100 of the present embodiment, a liquid can be circulated only with centrifugal forces of at least two directions, namely the downward direction and the leftward direction, so that the operation of circulating the liquid is extremely easy.

Here, in the above description, a case has been described in which the microchip having a circular path of the present embodiment is used for a method of quantitating the object substance by the ELISA method; however, the present invention is not limited to this case alone. For example, by filling the inside of column structure 105 with a carrier body carrying a heterogeneous catalyst and circulating a solution containing a reaction reagent (for example, various monomers), various organic reactions such as a polymerization reaction can be allowed to take place within the microchip.

Second Embodiment

FIGS. 3A and 3B are schematic views illustrating one example of a principal portion (circular path) of the fluid circuit with which the microchip of a second embodiment is provided, where FIG. 3A is a schematic top view thereof, and FIG. 3B is a cross-sectional view along the line IIIB-IIIB in FIG. 3A. The microchip of the present embodiment has a three-layer structure made by laminating a first substrate 310, a second substrate 320, and a third substrate 330. On second substrate 320, there is formed grooves that forms a path having a two-layer structure made of an upper-side path and a lower-side path (see FIG. 3B). The microchip of the present embodiment has a first reservoir 301, a measuring portion 305 disposed adjacent thereto, and a second reservoir 302, where measuring portion 305 and second reservoir 302 are connected by a first path 303. At the upper part of measuring portion 305 (on the side nearer to first reservoir 301), there is formed a third path 306 for discharging the measured liquid.

Also, in first reservoir 301 and second reservoir 302, there are respectively formed openings 301*a*, 302*a* that are in communication with a second path 304 formed on the lower side of second substrate 320. That is, first reservoir 301, measuring portion 305, first path 303, second reservoir 302, and second path 304 form a circular path, and a liquid can be circulated in the inside thereof. In the circular path of the present embodiment, first path 303 and second path 304 are formed at different positions relative to the thickness direction of the microchip, and therefore the circular path is perpendicular (or approximately perpendicular) to the microchip surface.

The microchip of the present embodiment having a measuring portion within the circular path can circulate a liquid repeatedly within the circular path, so that the measuring using the measuring portion can be repeatedly carried out, whereby a liquid of an integer multiple of the volume of the measuring portion can be measured.

A method of measuring a liquid using the microchip of the present embodiment will be described with reference to FIGS. 4A and 4B. First, by application of a centrifugal force in the downward direction in FIG. 4A, a liquid 401 (for example, a sample to be an object of testing or analysis using the microchip) is introduced into measuring portion 305 from the direction of the arrow in FIG. 4A (see FIG. 4A). At this time, the liquid that has overflowed from measuring portion 305 will pass through first path 303 to be stored into second reservoir 302.

Next, by application of a centrifugal force in the rightward direction, the measured liquid within measuring portion 305 is discharged from third path 306, and the liquid in second reservoir 302 that has overflowed passes through opening 302*a* to flow into second path 304 of the lower layer (not illustrated in FIGS. 4A and 4B), and then pass through opening 301*a* to be stored into first reservoir 301 (FIG. 4B). The liquid that has been discharged from third path 306 is not particularly limited, but will be stored into a reaction portion (mixing portion) or the like for reaction (or mixing) with a liquid reagent or the like.

Next, by application of a centrifugal force in the downward direction, the liquid in first reservoir 301 is introduced again into measuring portion 305 to be measured. By repetition of the cycle such as described above, measuring of a liquid can be carried out for plural times with use of measuring portion 305. According to the circular path of the present embodiment, a liquid can be circulated and measured with centrifugal forces in only two directions, namely the downward direction and the rightward direction, so that the operation of circulating a liquid is extremely easy.

Third Embodiment

Figure 5A:
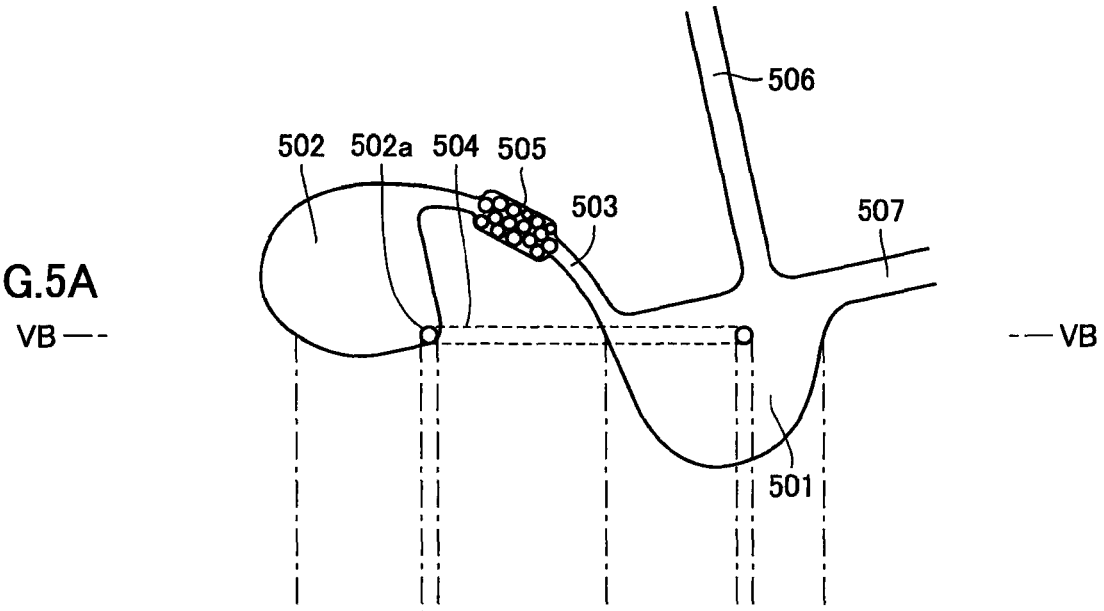
FIGS. 5A and 5B are schematic views illustrating one example of a principal portion of a fluid circuit with which the microchip of a third embodiment according to the present invention is provided.
Figure 5B:
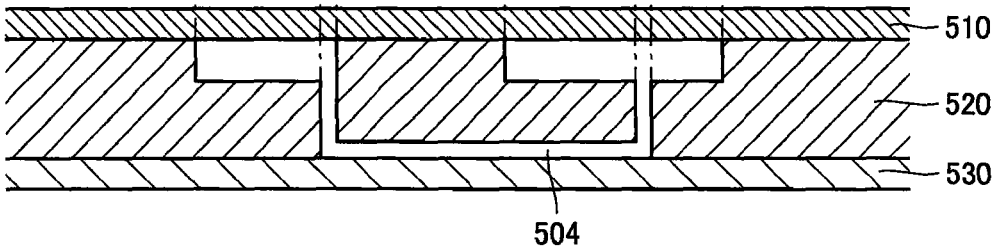

FIGS. 5A and 5B are schematic views illustrating one example of a principal portion (circular path) of the fluid circuit with which the microchip of a third embodiment is provided, where FIG. 5A is a schematic top view thereof, and FIG. 5B is a cross-sectional view along the line VB-VB in FIG. 5A. The microchip of the present embodiment has a three-layer structure made by laminating a first substrate 510, a second substrate 520, and a third substrate 530. On second substrate 520, there is formed grooves that forms a path having a two-layer structure made of an upper-side path and a lower-side path (FIG. 5B). In this point, the present embodiment is similar to the above-described second embodiment. The microchip of the present embodiment has a first reservoir 501 and a second reservoir 502, and these are connected by a first path 503 which is an upper-side path. In first reservoir 501, there are formed a third path 506 and a fourth path 507 for introducing or discharging a liquid to or from the circular path. Also, first path 503 has a column structure 505 similar to that of the above-described first embodiment, which is loaded with beads or the like to which an antibody is immobilized used in the ELISA method.

In first reservoir 501 and second reservoir 502, there are respectively formed openings 501*a*, 502*a* that are in communication with a second path 504 formed on the lower side of second substrate 520. That is, first reservoir 501, first path 503, second reservoir 502, and second path 504 form a circular path, and a liquid can be circulated in the inside thereof. In the circular path of the present embodiment, first path 503 and second path 504 are formed at different positions relative to the thickness direction of the microchip, and therefore the circular path is perpendicular (or approximately perpendicular) to the microchip surface. According to the circular path having such a construction, effects similar to those of the above-described first embodiment can be produced.

FIGS. 6A to 6D are schematic flow charts showing one example of a method of using the microchip of the present embodiment. Hereafter, with reference to FIGS. 6A to 6D, one example of a method of using the microchip of the present embodiment will be described.

Figure 6A:
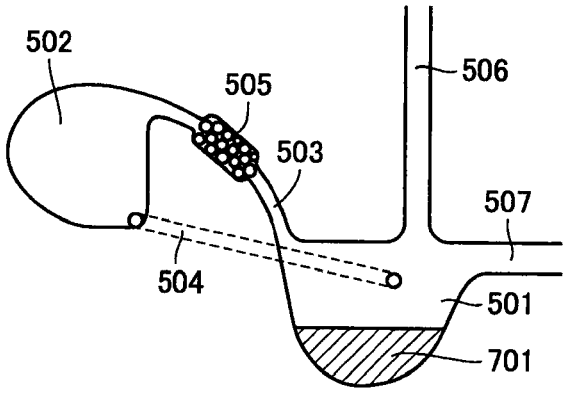
FIGS. 6A to 6D are schematic flow charts illustrating one example of a method of using the microchip of the third embodiment according to the present invention.
Figure 6B:
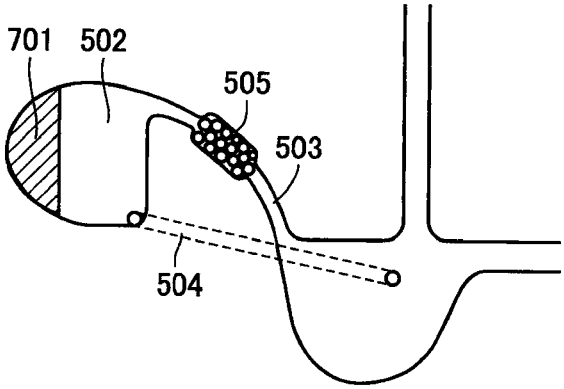
Figure 6C:
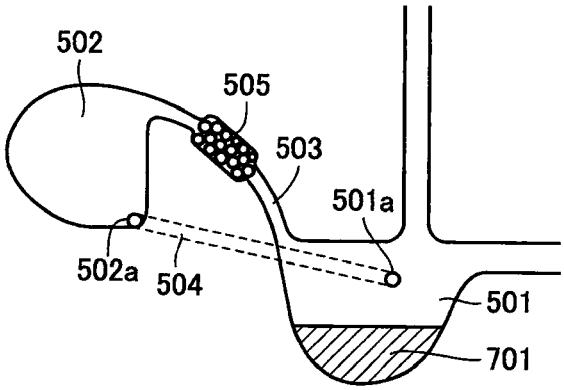
Figure 6D:
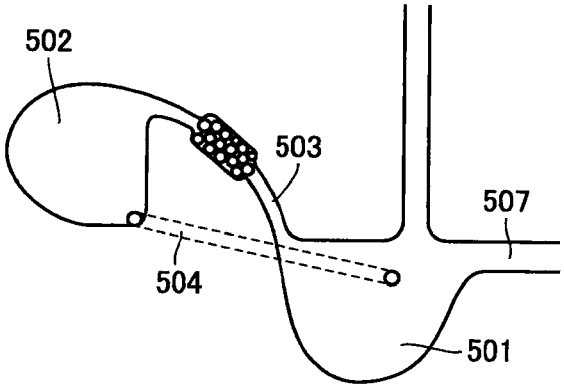

First, by application of a centrifugal force in the downward direction, a liquid 701 is introduced into the circular path by passing through third path 506, and is stored into first reservoir 501 (FIG. 6A). As liquid 701, a cleaning liquid in the ELISA method shown in the above-described first embodiment can be mentioned as an example; however, it is not particularly limited. Next, by application of a centrifugal force in the leftward direction, liquid 701 passes through first path 503 and column structure 505 to be moved to second reservoir 502 (FIG. 6B). Subsequently, by application of a centrifugal force in the downward direction, liquid 701 in second reservoir 502 passes through opening 502*a* to reach second path 504, and flows out from opening 501*a* of first reservoir 501 to be stored again into first reservoir 501 (FIG. 6C). Such circulation of a liquid between first reservoir 501 and second reservoir 502 can be carried out for plural times in accordance with the needs. Finally, by application of a centrifugal force in the rightward direction, liquid 701 is discharged from the circular path by passing through fourth path 507 (FIG. 6D).

Although the present invention has been described and illustrated in detail, it is clearly understood that the same is by way of illustration and example only and is not to be taken by way of limitation, the scope of the present invention being interpreted by the terms of the appended claims.

What is claimed is:

1. A microchip having a fluid circuit therein for passing a liquid, said fluid circuit having:

a first reservoir and a second reservoir for storing at least a part of said liquid;

a first path connecting said first reservoir and said second reservoir;

a second path connecting said first reservoir and said second reservoir at a position different from said first path; and a portion including therein beads to which an antibody is immobilized, wherein said portion is provided at a bottom of the second reservoir, and wherein a bottom of said portion and a bottom of the first reservoir are connected by the second path, wherein the first reservoir and the second reservoir are connected in an upper part thereof by the first path and wherein said first reservoir, said second reservoir, said first path, said second path and said portion constitute a circular path capable of circulating said liquid to reintroduce into said portion the liquid that has been passed through said portion, and wherein the microchip is arranged such that said liquid is circulated within said circular path by application of a first centrifugal force in a first direction and by application of a second centrifugal force in a second direction at an angle of about ninety degrees with respect to the first direction, wherein the first centrifugal force and the second centrifugal force are applied to the microchip by revolution of the microchip around a first centrifugal center and a second centrifugal center that are positioned outside the microchip, respectively, wherein the liquid can be circulated within the circular path only in an order of the first reservoir, the first path, the second reservoir, the portion including therein beads and the second path, and wherein in the fluid circuit, the first reservoir is positioned on a side nearer to the first centrifugal center for the first centrifugal force as compared with the second reservoir, and the first reservoir is positioned on a side farther from the second centrifugal center for the second centrifugal force as compared with the second reservoir.

2. The microchip according to claim 1, having a measuring portion to measure said liquid at some position within said circular path.

3. The microchip according to claim 1, wherein said first path and said second path are formed at an identical position with respect to a thickness direction of the microchip.

4. The microchip according to claim 1, wherein said first path and said second path are formed at different positions with respect to a thickness direction of the microchip.

5. The microchip according to claim 1, wherein said fluid circuit has a third path for introducing said liquid into said circular path or discharging said liquid from said circular path at the end of the upper part of said first reservoir that is opposite to the side where said first path is connected.

6. The microchip according to claim 1, wherein a path diameter of said second path is smaller than a diameter of the bottom of said portion including therein beads.

* * * * *